United States Patent [19]

Casey

[11] 3,986,641

[45] Oct. 19, 1976

[54] PRODUCT ISOLATING LINER FOR PRESSURIZED DISPENSING CONTAINER

[76] Inventor: Don E. Casey, 645 Neil Ave., Columbus, Ohio 43215

[22] Filed: Jan. 20, 1976

[21] Appl. No.: 650,738

[52] U.S. Cl. ..... 222/95

[51] Int. Cl.[2] ..... B65D 35/28; B65D 83/14

[58] Field of Search ..... 222/95, 107, 386.5, 222/92

[56] References Cited

UNITED STATES PATENTS

| | | | |
|---|---|---|---|
| 3,181,735 | 5/1965 | Miskel et al. | 222/95 |
| 3,838,794 | 10/1974 | Cogley | 222/95 |
| 3,905,517 | 9/1975 | Friedrich et al. | 222/95 |

*Primary Examiner*—Allen N. Knowles
*Assistant Examiner*—Hadd Lane
*Attorney, Agent, or Firm*—Frank H. Foster

[57] ABSTRACT

A barrier pack liner for an aerosol container, the liner having a plurality of random, surface contour, irregularities, such as inwardly extending bosses, dents, humps or dimples, formed on its interior wall and arranged to form communicating interstices upon the engagement of one wall surface against another. The communicating interstices prevent the pinch off of product during collapse of the liner.

8 Claims, 5 Drawing Figures

PRODUCT ISOLATING LINER FOR PRESSURIZED DISPENSING CONTAINER

BACKGROUND OF THE INVENTION

This invention relates generally to pressurized dispensing containers and more particularly relates to an improved, product-isolating, collapsable liner for such containers.

Aerosol containers are extensively used for storing, marketing and conveniently dispensing a great variety of products.

For some products it has been found desirable to provide a liner within the relatively rigid outer container in order to separate the product from the propellant. Ordinarily the product is contained within the liner and the propellant surrounds the liner so that the liner collapses under the influence of the propellant as product is expelled through a valve formed in communication with the interior of the liner. Usually, the valve is manually operable and is mounted in a closure which is secured to the top of the outer container.

Pressurized dispensing containers having a liner are commonly known as barrier packs. There are two areas of barrier pack design considerations which are important in evaluating the commercial desirability of a barrier pack container. The first is the ease, convenience and economical efficiency of the assembly of the barrier pack components and the filling of the barrier pack container with product and propellant. The second is the efficiency with which the barrier pack container is able to expell the contained product, that is, the proportion of contained product which can be expelled.

Conventional aerosol containers, of the type which do not have an interior lining, arrive at the filling machine in two parts. The first part is the main body of the container as supplied by the container manufacturer. It has a cylindrical side wall portion, an attached bottom and an attached crown. The crown has a relatively large open mouth or filler hole at its central top which is bounded by a filler ring formed by an annular, outward curl. The second part of the conventional aerosol container is a valve closure carrying a manual valve dispensing mechanism. The filling machine inserts the product and propellant into the main body of the container through the filler hole and then crimps the valve closure to the filler hole of the crown to seal the two parts together.

Because of the design of some product-isolating liners, very substantial modifications in this process have been necessary therefore reducing the economic desirability of using such liners. For example, some liners must be inserted prior to the attachment of the crown or the bottom to the cylindrical side walls of the outer container. Some liners require a small propellant filler hole in the bottom of the container which must be sealed by a plug after the propellant is filled into the container.

There is, therefore, a need for an improved barrier pack liner requiring minimal modification of the conventional filling operation, which may be inserted through the conventional filler hole of the main container body and which will allow both product and propellant to be filled into the container through the filler hole.

Any container liner, when entirely collapsed, will nonetheless retain some product between its interior walls. If, during collapse of the liner, the interior walls come together to pinch off and isolate a region of product, then a substantial volume of product will be unable to be exhausted from the container. In order to avoid such pinch off, containers have been annularly or longitudinally pleated in order to provide for their orderly collapse and to minimize the residual volume of unexpellable product. However, because of the substantial thickness of the accumulated folded pleats as they fold together, a significant, central, interior volume of unexpellable product remains in such pleated liners. This is especially true of annularly pleated liners. There is therefore, a need for a liner which can further reduce the volume of residual unexpellable product.

One limitation of previously known pleated liners is that they place severe limitations on the shape of their outer containers. For example, the annularly pleated liner is limited to cylindrical containers or to conically shaped containers having the valved closure at its large end. The longitudinally pleated liner permits a greater variety of outer container shapes but requires that a particular liner be manufactured for a particularly shaped container.

There is, therefore, a need for a single liner which can conform to a variety of container shapes.

OBJECTS AND SUMMARY OF THE INVENTION

It is therefore an object of the present invention to provide an improved barrier pack liner capable of expelling an efficiently high proportion of its initially contained product.

Another object of the present invention is to provide a barrier pack liner which can be inserted through the conventional filler hole of a dispensing container and which further allows the filling of both product and propellant through the same filler hole, thereby requiring minimal modification of the conventional filling process.

It is a further object of the invention to provide a barrier pack container which can be inserted through the filler hole of the crown of the container body so that the liner can be easily used with glass container bodies which have uniform, unitary bodies and with integral, one piece metal container bodies formed by impact extrusion.

It is a still further object of the invention to provide a container liner which provides economic encouragement for the reuse of dispensing containers.

It is a further object of the invention to provide a barrier pack liner of simple and easily manufacturable construction yet which effectively prevents the pinch off or isolation of a portion of the contained product during collapse of the liner.

It is still another object of the present invention to provide a barrier pack liner which can conform to a variety of container shapes.

In summary, the improved barrier pack liner of the present invention comprises a flexible liner having a plurality of surface contour irregularities formed on its interior wall and arranged to form communicating interstices upon the engagement of on one portion of the interior wall surface against another portion of the interior wall surface.

Further objects and features of the invention will be apparent from the following specification and claims when considered in connection with the accompanying drawings illustrating the preferred embodiments of the invention.

In describing the embodiments of the invention illustrated within the drawings specific terminology will be resorted to for the sake of clarity. However, it is not intended to be limited to the specific terms so selected and it is to be understood that each specific terms includes all technical equivalents which operate in a similar manner to accomplish a similar purpose.

DETAILED DESCRIPTION

Figure 1:
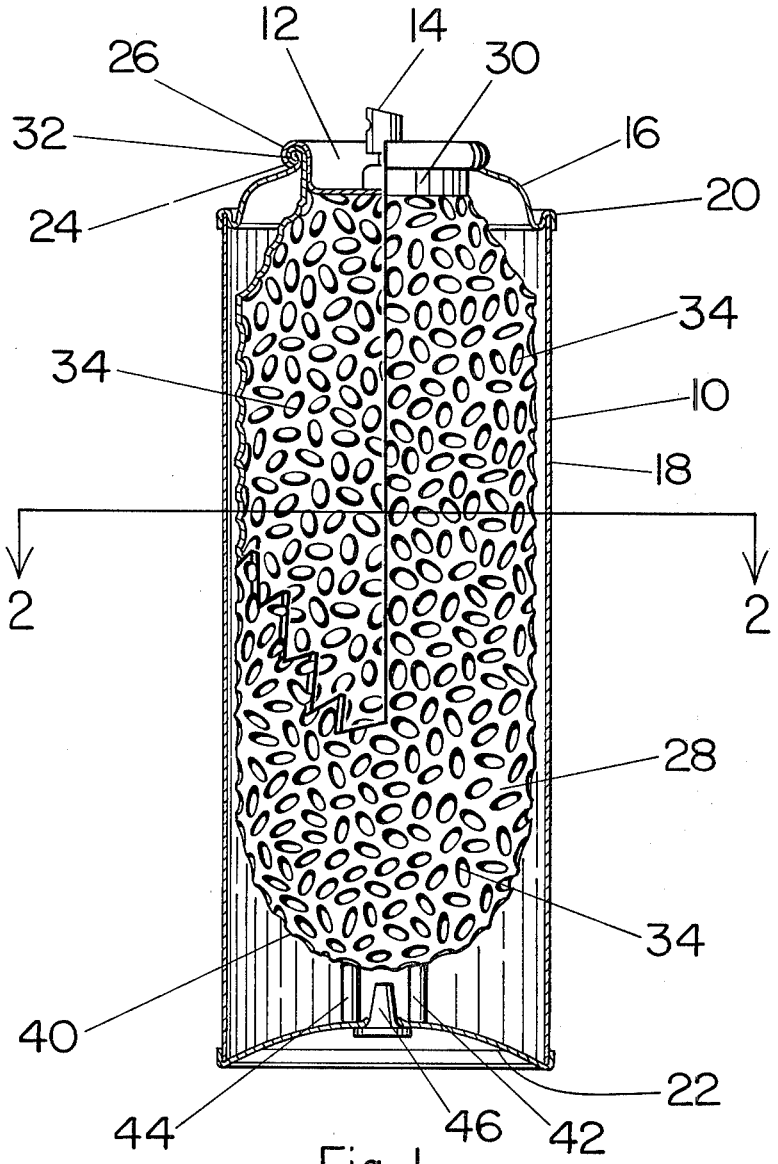
FIG. 1 is a view in vertical half section of a barrier pack container embodying the present invention and illustrating the liner with a segment removed in quarter section.
Figure 2:
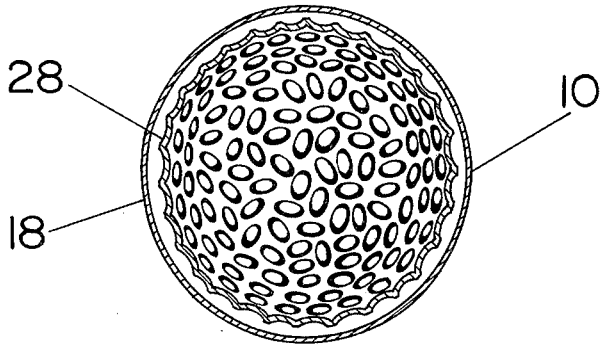
FIG. 2 is a view in horizontal section taken substantially along the line 2—2 of FIG. 1.

FIG. 1 and FIG. 2 illustrate a barrier pack dispenser having a main container body 10 and a closure 12 which carries a valve mechanism 14. The main container body 10 has a top crown portion 16 joined to its cylindrical side wall 18 by a compressed or crimped seam 20 and a bottom portion 22 which may be similarly crimped or welded to the cylindrical wall 18.

The crown 16 is formed with an open mouth or filler hole which is defined and bounded by an annular outward curl 24. A mating annular curl 26 is formed around the closure 12.

An interior, collapsable liner 28 is contained in the outer container 10. It has a neck portion 30 also formed with a mating annular curl 32 which is compressed between the curl 24 of the filler ring and the curl 26 of the closure 12. The liner 28 serves to separate the usable contents or product, which is not illustrated but which is contained within the liner 28, from the propellant which is housed between the exterior wall of the liner 28 and the interior wall of the container 10.

The liner has a plurality of surface contour irregularities 34 which are formed on its interior wall. These irregularities 34 are arranged to form communicating interstices upon the engagement of one portion of the interior wall surface against another portion of the interior wall surface during collapse of the liner. These interstices provide minute passageways through which product can flow under the influence of the pressure of the propellant.

The preferred surface contour irregularities are inwardly or interiorly extending bosses or dimples which are randomly arranged and distributed about the interior surface wall of the liner. Preferably the liner is blow molded and consequently these inward bosses or dimples appear inversely on the exterior surface of the liner. However, it should be noted that it is only of importance that the surface irregularities appear on the interior wall surface. Consequently the exterior wall surface could be entirely smooth. This might be done, for example, with a cast metal foil liner.

Although an inwardly extending, pebbled surface of some type is preferred, it should be appreciated that the surface irregularities could take the form of outwardly extending dents, cavities or other shapes formed into the interior wall of the liner. The wall regions between the dents function like bosses while the dents function as the product conveying interstices. However, inwardly or interiorly extending bosses or dimples forming a pebbled surface are preferred in order to minimize the interference or resistance which may be experienced when the liner is inserted through the filler ring into the container.

Although the surface contours can be in a regular or orderly pattern and still come within the broadest scope of the present invention, it is desirable that they be randomly arranged so that there can be no meshing or interlocking mating of the surface irregularities when the interior wall surfaces come together during the collapse of the liner.

To provide a more random pattern, it is further desirable that the interiorly extending bosses forming the desired surface irregularities comprise a plurality of randomly arranged bosses of differing sizes and shapes. The use of differing sizes and shapes further assures that a mating interlock or meshing of the surface irregularities cannot occur.

There is of course a very broad range of dimensional parameters which are useful in the construction of liners embodying the present invention. The distance between the bosses, which determines the size of the interstices, may be selected so that the average cumulative cross sectional area of interstices is at least equal to the minimum cross sectional area of the outlet passageway of the largest valve which might be used on the container. In this way, the flow rate of product would not be diminished.

The number, size and density of surface irregularities on the liner interior surface is variable and these three parameters are interrelated. It is, for example, quite clear that the existence of only a few irregularities in an entire liner would not come within the scope of the present invention because these could not prevent most pinch off conditions. It is equally clear from the concept of the present invention that the term "surface irregularities" does not include the pleated construction of prior art liners. Pleated surfaces do not provide interstices upon interfacing contact.

However, it is equally clear that, for some products, a smaller number and lesser density of surface irregularities than that illustrated in FIG. 1 may be utilized especially if the surface irregularities are of considerable depth. At the opposite end of the range of dimensions contemplated by the present invention it is also clear that microscopic surface irregularities are not contemplated because they too do not permit the formation of interstices which can allow the passage of product.

In the filling operation, it is apparent from FIG. 1 that during the insertion of the liner axially downwardly through the filler hole formed by the curl 24, the liner must be radially inwardly deformed or squeezed in order to pass through the filler hole. While the lower portion 40 of the liner 28 could be contoured to facilitate this inward deformation, it is preferable that a conical, funnel-shaped apparatus be positioned above the filler ring and be tapered to inwardly deform and guide the liner into the container 18.

A pair of downwardly protruding spacer legs 42 and 44 are formed on the bottom portion 40 of the liner 28. They function as spacers which stop the downward movement of the liner when it is inserted at a rapid rate of speed and thereby prevent its momentum from carrying the curl 32 formed at the mouth of the liner down past the curl 24 formed at the filler hole. Preferably these protrusions 42 and 44 are a pair of prongs approximately ⅛ inch in diameter. They are spaced to avoid contact with the plug 46 which is inserted in the propellant filler hole in the bottom 22 and assure sufficient clearance for it.

Figure 3:
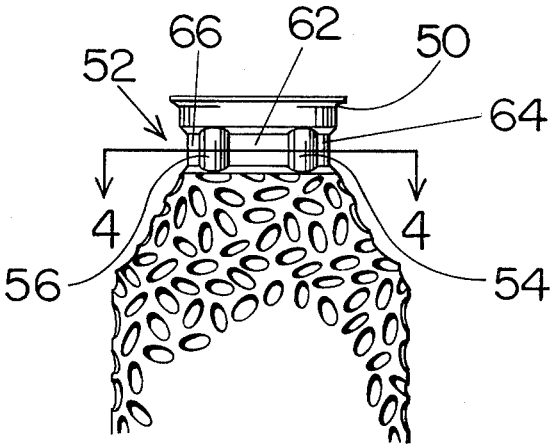
FIG. 3 is a view in side elevation of an alternative container liner having neck construction embodying the present invention.
Figure 4:
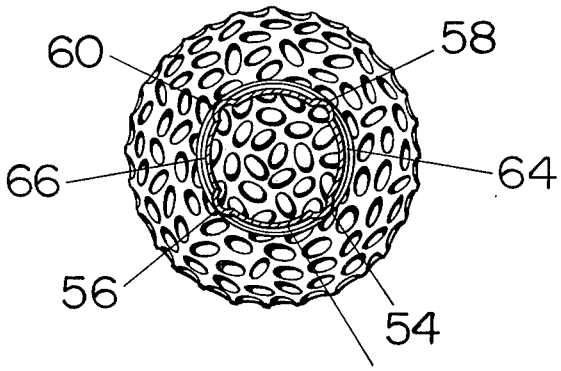
FIG. 4 is a view in horizontal section taken substantially along the line 4—4 of FIG. 3.
Figure 5:
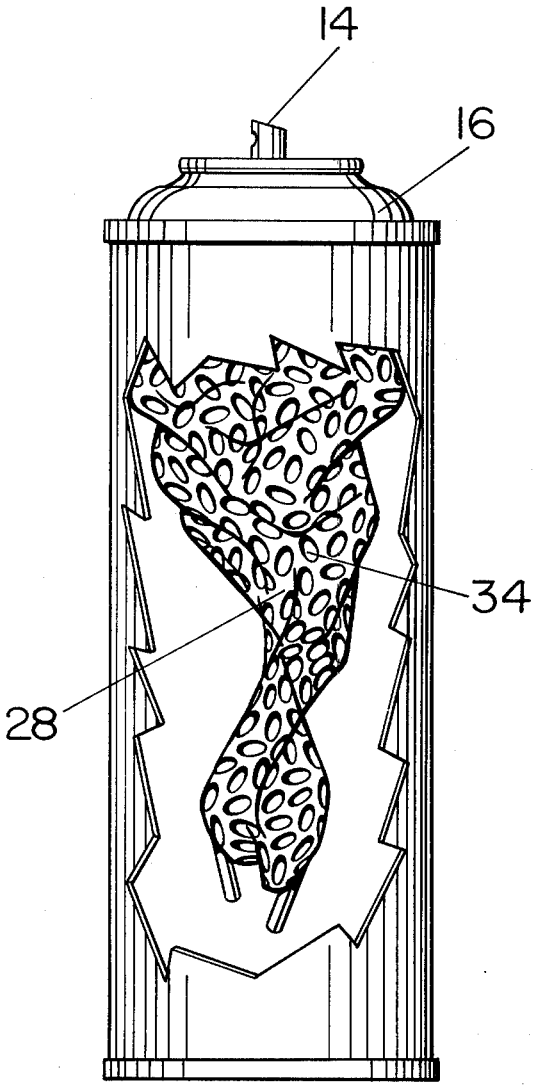
FIG. 5 is a view in side elevation of a barrier pack container embodying the present invention and having a segment of the relatively rigid outer container removed to expose a collapsed liner.

Liners embodying the present invention may of course be formed with a variety of neck and mouth portions. FIGS. 3 and 4 illustrate an improved neck portion embodying the present invention.

The liner of FIGS. 3 and 4 has a mouth portion formed with a curl 50 and a neck 52 adjacent the curl 50. The neck comprises alternate, relatively outwardly protruding spacer portions 54, 56, 58 and 60 and relatively inwardly extending neck wall portions 62, 64, 66 and 68.

With this neck construction, the liner may be inserted into the outer relatively rigid container 10 until the outwardly extending spacer portions 54 – 60 seat, intermediate their ends, against the curl portion 24 of the outer container 10. In this position, propellant insertion passageways are temporarily provided during the filling operation between the neck wall portions 62 – 68 and the curl portion 24 of the outer container 10.

After the dispensing container has been filled, the valve closure 12 may be forced downwardly and crimped onto the filler ring in the conventional manner. This downward motion of the closure valve forces the curl portion 50 of the liner against the curl 24 of the filler ring to allow conventional sealing.

With the above structure the bottom propellant filler hole and plug are unnecessary because the propellant may be inserted into the container after the liner has been inserted.

In forming the above improved neck, it is desirable to manufacture the liner so that it will be somewhat taller, for example ⅛ inch to ¼ inch taller, than the axial interior height of the container so that the spacer portions of the neck will be properly aligned against the curl of the filler hole when the downward protrusions 42 and 44 contact the interior bottom of the container.

Attachment of the valve closure will then produce a slight, resilient, downward deformation of the liner.

It is to be understood that, while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

What is claimed is:

1. An improved aerosol barrier package of the type having a relatively rigid, outer container and an interior, collapsable liner for separating its usable contents from a propellant and having a valve closure, wherein the improvement comprises a flexible liner having a plurality of surface contour irregularities formed on its interior wall and arranged to form communicating interstices upon the engagement of one portion of the interior wall surface against another portion of the interior wall surface.

2. A package according to claim 1 wherein said irregularities comprise a plurality of interiorly extending bosses.

3. A package according to claim 1 wherein said irregularities are randomly arranged.

4. A package according to claim 1 wherein said irregularities have a density of at least one per square inch of interior wall surface.

5. A package according to claim 1 wherein said surface irregularities comprise a plurality of indentations.

6. A package according to claim 1 wherein said liner is formed with at least one outwardly protruding spacer leg for spacing said liner from the bottom wall of said outer container.

7. A package according to claim 1 wherein said outer container has a filler hole and wherein said liner has a mouth and a neck adjacent the mouth, the neck comprising alternate, relatively outwardly protruding, spacer portions and relatively inwardly extending neck wall portions for temporarily providing propellant insertion passageways during the filling operation between said neck wall portions and the filler hole of said outer container.

8. A package according to claim 1 wherein said surface irregularities comprise a plurality of randomly arranged, interiorly extending bosses of differing sizes and shapes.

* * * * *